US012692055B2

(12) United States Patent
Yamagishi

(10) Patent No.: US 12,692,055 B2
(45) Date of Patent: Jul. 28, 2026

(54) SUBSTRATE STORAGE CONTAINER

(71) Applicant: Shin-Etsu Polymer Co., Ltd., Tokyo (JP)

(72) Inventor: Hiroki Yamagishi, Saitama (JP)

(73) Assignee: Shin-Etsu Polymer Co., Ltd., Tokyo (JP)

( * ) Notice: Subject to any disclaimer, the term of this patent is extended or adjusted under 35 U.S.C. 154(b) by 185 days.

(21) Appl. No.: 18/702,271

(22) PCT Filed: Aug. 8, 2022

(86) PCT No.: PCT/JP2022/030269

§ 371 (c)(1),
(2) Date: Oct. 25, 2024

(87) PCT Pub. No.: WO2023/067877

PCT Pub. Date: Apr. 27, 2023

(65) Prior Publication Data

US 2025/0296749 A1 Sep. 25, 2025

(30) Foreign Application Priority Data

Oct. 19, 2021 (JP) ..... 2021-170833

(51) Int. Cl.
*B65D 55/12* (2006.01)

(52) U.S. Cl.
CPC ..... *B65D 55/12* (2013.01); *B65D 2255/20* (2013.01)

(58) Field of Classification Search
CPC .. B65D 2255/20; B65D 55/12; B65D 55/022; B65D 85/30; H01L 21/67369; H01L 21/67386; H01L 21/67373
(Continued)

(56) References Cited

U.S. PATENT DOCUMENTS 6,457,598 B1 * 10/2002 Hsieh ..... H01L 21/67373 220/323
7,077,270 B2 * 7/2006 Matsutori ..... H01L 21/67376 206/711

(Continued)

FOREIGN PATENT DOCUMENTS

JP 2002368074 A 12/2002
JP 2003133405 A 5/2003

(Continued)

OTHER PUBLICATIONS

International Search Report issued in International Application No. PCT/JP2022/030269, mailed Sep. 6, 2022 (8 pages).

(Continued)

*Primary Examiner* — Chun Hoi Cheung
(74) *Attorney, Agent, or Firm* — Osha Bergman Watanabe & Burton LLP

(57) ABSTRACT

Provided is a substrate storage container that can eliminate lower coupling strength between a slide member and bent locking member, and bent locking member falling from the slide member without a metal pin. The container includes a lid fitted to an open front face of a container body, and locking mechanism that locks the lid. The locking mechanism includes an operating reel supported on the lid and turned by external operation, connecting bar that slides to vertical direction of the lid as the reel turns, locking claw projected from a passage opening in the periphery of the lid as the connecting bar slides and can be engaged with a locking pocket on front inner circumference of the container body. The locking claw is coupled rotatably at distal part of the connecting bar by a resin pin which can reduce generation of metal ions and eliminate adverse effects on semiconductor wafers.

18 Claims, 10 Drawing Sheets

(58) Field of Classification Search
USPC ..... 206/710–712, 832
See application file for complete search history.

(56) References Cited

U.S. PATENT DOCUMENTS

| | | | | |
|---|---|---|---|---|
| 7,549,552 | B2 | 6/2009 | Hasegawa et al. | |
| 7,828,341 | B2 * | 11/2010 | Hasegawa | H01L 21/67373 70/120 |
| 11,398,395 | B2 * | 7/2022 | Smith | H01L 21/67373 |
| 2005/0230398 | A1 | 10/2005 | Hasegawa et al. | |
| 2009/0026109 | A1 | 1/2009 | Hasegawa et al. | |
| 2010/0206767 | A1 | 8/2010 | Odashima et al. | |
| 2016/0163575 | A1 * | 6/2016 | Phark | H01L 21/67373 206/710 |

FOREIGN PATENT DOCUMENTS

| | | | |
|---|---|---|---|
| JP | 2005306411 | A | 11/2005 |
| JP | 2006303015 | A | 11/2006 |
| JP | 2013004852 | A | 1/2013 |
| JP | 2013038217 | A | 2/2013 |
| JP | 2013239643 | A | 11/2013 |
| JP | 2021028936 | A | 2/2021 |
| KR | 20070120945 | A | 12/2007 |

OTHER PUBLICATIONS

Written Opinion issued in International Application No. PCT/JP2022/030269; Dated Sep. 6, 2022 (5 pages).
Office Action issued in Korean Patent Application No. 10-2024-7009758; Dated Jan. 26, 2026 (14 pages).

* cited by examiner (a)

Prior Art (b)

Prior Art (c)

SUBSTRATE STORAGE CONTAINER

TECHNICAL FIELD

The present invention relates to a substrate storage container used for transporting and storing substrates such as semiconductor wafers.

BACKGROUND TECHNOLOGY

In semiconductor factories, substrate storage containers called FOUPs (Front Opening Unified Pods) are used to transport and store large-diametric semiconductor wafers. This substrate storage container is, as partially shown in FIGS. 14(*a*), 14(*b*) and 14(*c*), includes a lid 10 that is fitted in an open front 2 of a container body 1 for storing semiconductor wafers, and a locking mechanism 20 for locking the lid 10 fitted to the container body 1. The locking mechanism 20 is built in the lid 10, and this locking mechanism 20 is operated by a lid opening/closing device (opener) standardized by the SEMI standards.

The lid 10 is formed in a substantially box shape that is fitted into the open front 2 of the container body 1 and formed with a plurality of passage openings 12 bored for the locking mechanism 20 in the peripheral edge thereof. The locking mechanism 20 includes: a pair of operating reels that are supported by the lid 10 and turned by a key operation of the lid opening/closing device; a plurality of connecting bars 24A that move upward and downward as each operating reel turns; and a plurality of locking claws 27A that can project from the passage openings 12 of the lid 10 and become engaged with the locking pockets 4 on the front inner circumference of the container body 1 as the connecting bars 24A advance (refer to Patent Documents 1, 2, 3, 4, 5).

As shown in FIGS. 14(*a*), 14(*b*) and 14(*c*) and in Patent Document 1, each locking claw 27A is swingably supported by a metal pin 50 located near the passage opening 12 of the lid 10 while the claw is also coupled to the distal part of the connecting bar 24A, swingably on the metal pin 50. At a distal part 33 a pressing roller 36 that can contact the interior of the locking pocket 4 on the front inner circumference of the container body 1 is rotatably supported by the metal pin 50. These plural metal pins 50 use, for example, SUS pins having a diameter of 1.0 mm, and are press-fitted into the plurality of holes of the locking claw 27A or the distal part of the connecting bar 24A or inserted in a cantilevered manner.

In the above configuration, when the lid 10 is fitted and locked to the open front 2 of the container body 1, the lid opening/closing device fits the lid 10 to the open front 2 of the container body 1 (see FIG. 14(*a*)) and turns each operating reel of the locking mechanism 20 by means of the operation key thereof. As a result, the operating reel turns to advance the plurality of connecting bars 24A toward the peripheral edge of the lid 10. As the connecting bars 24A advance, the locking claws 27A pass through respective passage openings 12 from the interior of the lid 10 and come out from the lid (see FIG. 14(*a*)). The thus projected locking claws 27A become engaged with the locking pockets 4 of the container body 1. This engagement of the locking claws 27A squeezes the fitted lid 10 into the front of the container body 1 and locks the lid (see FIG. 14(*b*)).

On the other hand, when the lid 10 is unlocked and removed from the container body 1, the lid opening/closing device turns each operating reel of the locking mechanism 20 to the original reference position by means of the operation key. Then, the operating reel turns and returns to retract the plurality of advanced connecting bars 24A to the original reference positions inside the lid 10. As the connecting bars 24A retract and return, the projected locking claws 27A return from the locking pockets 4 of the container body 1 into the lid housing, passing through respective passage openings 12. This resetting of the locking claws 27A makes the lid 10 that has been fitted in the front 2 of the container body 1 removable (see FIG. 14(*c*)), so that the lid 10 is pulled out and removed from the container body 1 by the lid opening/closing device.

PRIOR ART DOCUMENTS

Patent Documents

Patent Document 1:
Japanese Patent Application Laid-open No. 2013-038217
Patent Document 2:
Japanese Patent Application Laid-open No. 2021-28936
Patent Document 3:
Japanese Patent Application Laid-open No. 2002-368074
Patent Document 4:
Japanese Patent Application Laid-open No. 2005-306411
Patent Document 5:
Japanese Patent Application Laid-open No. 2006-303015

SUMMARY OF THE INVENTION

Problem to be Solved by the Invention

The conventional substrate storage container is constructed as described above, and the distal part of the connecting bar 24A and the locking claw 27A are coupled by metal pins 50. However, from the viewpoint of eliminating diverse adverse effects on the semiconductor wafers to be stored, it is desirable to avoid using metal pins 50 as much as possible.

On the other hand, if no metal pins 50 are used and if pins made of other materials are used without consideration, repeated use of the locking mechanism 20 over a long period of time may lower the coupling strength between the connecting bar 24A and the locking claw 27A and may cause a risk that the locking claw 27A may fall off from the distal part of the connecting bar 24A.

The present invention has been devised in view of the above, and it is therefore an object of the invention to provide a substrate storage container that can eliminate the risk of the coupling strength between a slide member and a bent locking member being lowered and the risk of the bent locking member falling off from the slide member without using metal pins.

Means to Solve the Problem

In order to solve the above problems, the substrate storage container comprises: a lid that is fitted to an opening of a container body capable of storing a substrate; and a locking mechanism that locks the fitted lid, wherein the lid comprises: a lid housing that is removably fitted to an open front surface of the container body; and a front plate that covers a front surface of the lid housing, wherein the locking mechanism is disposed between the lid housing and the front plate; and a passage opening for the locking mechanism is disposed on a periphery of the lid housing so as to be opposite to a locking pocket on a front inner circumference of the container body, the locking mechanism comprises: an operating member that is supported on the lid and turned by an external operation; a slide member that slides as the operating member turns; and a bent locking member that is projected from the passage opening of the lid as the slide member slides and can be engaged with (can be caught on) the locking pocket on the front inner circumference of the container body, wherein the bent locking member being rotatably connected to a distal part of the slide member by a resin shaft having a diameter of 1.5 mm or greater, and the bent locking member of the locking mechanism is configured to rotate in a thickness direction of the lid while a center of rotation of the bent locking member is arranged at a forepart on a front side of the bent locking member.

In the above, the substrate storage container may be configured so that the locking mechanism comprises a holder member that is fitted and assembled with the slide member and the bent locking member, and the forepart on the front side of the bent locking member is rotatably supported on both sides of the holder member by means of a resin fulcrum shaft having a diameter of 1.5 mm or greater.

The substrate storage container may be configured so that the holder member supports a plurality of resin fulcrum shafts at both sides of the holder member, and penetrated portions of the resin fulcrum shafts that penetrate through respective sides of the holder member are inserted into the forepart on the front side of the bent locking member.

The substrate storage container may be configured so that the bent locking member and the holder member can be formed to separate into respective two parts with respect to a width direction of the slide member, and the resin fulcrum shafts to be supported respectively by both side parts of the holder member are formed protruding from respective sides of the forepart on the front side of the bent locking member while resin shafts to be penetrated through the distal part of the slide member are supported on a rear side of the bent locking member.

The substrate storage container may also be configured so that resin fulcrum shafts to be supported respectively by both side parts of the holder member are formed protruding from respective sides of the forepart on the front side of the bent locking member, and a plurality of joint pipes are formed near a bent portion on a rear side of the bent locking member while a resin shaft that penetrates through the distal part of the slide member is inserted into each of the joint pipe, whereby the holder member can be separated with respect to a width direction of the slide member.

The substrate storage container may be configured so that the distal part of the bent locking member is forked into two branches so as to form a substantially groove shape, and a resin support shaft having a diameter of 1.5 mm or greater is inserted through the forked distal part of the bent locking member while a pressing roller that comes in rotatable contact with the inside of the locking pocket of the container body is fitted on the resin support shaft.

The substrate storage container may be configured so that the resin support shaft is rotatably mounted between the branches of the forked distal part of the bent locking member, and the resin support shaft being formed with a recess on a peripheral side of the resin support shaft while a projection that mates with the recess of the resin support shaft is formed on an inner circumferential surface of the pressing roller.

A plurality of ribs that contact the inside of the locking pocket of the container body may be formed in a distal part of the bent locking member.

It is preferable that among the resin shaft, the resin fulcrum shaft and the resin support shaft, at least the resin shaft is formed of polyetheretherketone resin, polycarbonate resin, polybutylene terephthalate resin, polyacetal resin, polyetherimide resin, polyether sulfone resin, polyphenylene sulfide resin, or polyamide-imide resin.

The substrate storage container may be configured so that an angle θ formed by a vertical line and an imaginary line is specified to fall within a range from 0.5° or greater to 200 or less, where the vertical line is drawn from the center of the rotation of the bent locking member when the locking mechanism is locked, toward the locking pocket of the container body and the imaginary line is drawn from the center of the rotation of the bent locking member when the locking mechanism is locked, to a position of the contact of the bent locking member with the locking pocket of the container body.

Herein, the substrates in the scope of claims, at least, include silicon wafers, glass substrates, mask substrates and others of 300 mm or 450 mm in diameter. The container body and the lid may be transparent, opaque, or translucent. The slide member of the locking mechanism is mostly plate-shaped, but it may also be rod-shaped. Further, the resin shaft, the resin fulcrum shaft, and the resin support shaft may include at least various kinds of pins and bosses made of resin and may be singular or plural. The resin shaft may be integrated with the bent locking member or may be separated. The resin fulcrum shaft may also be integrated with the bent locking member or may be separated. The resin support shaft may be rotatably mounted or fixedly mounted. The term rotation includes at least swinging (swinging motion).

Of the bent locking member and the holder member, at least the holder member can be configured to be separable with respect to the width direction of the slide member. Of an opposite cover plate that is opposite the front side surface of the slide member and the bent locking member, a pair of side plates arranged on both sides of the opposite cover plate and sandwiching the slide member and the bent locking member from left and right, and an anti-fall member mounted between the paired side plates and located on the rear side of the slide member, the holder member includes, at least, the paired side plates, and is made to possible to rotatably support the resin fulcrum shaft between the paired side plates. The holder member can be attached and fixed to the lid housing of the lid, as required.

According to the present invention, when the distal part of the slide member and the bent locking member of the locking mechanism are coupled, resin shafts made of resin are used instead of metal pins, so that it is possible to reduce the generation of metal ions, and hence eliminate diverse adverse effects on the substrates. In addition, instead of using an unspecific resin shaft, resin shafts of an increased diameter, i.e., having a diameter of 1.5 mm or greater, which are thicker than the conventional configuration, are used to improve the strength and rigidity of the resin shaft, so that it is possible to eliminate the risk of the coupling strength between the slide member and the bent locking member being degraded and the risk of the bent locking member falling off from the slide member even if the locking mechanism is used repeatedly over a prolonged period of time.

Advantages of the Invention

According to the present invention, without use of metal pins, it is possible to effectively eliminate the risk of the coupling strength between the slide member and the bent locking member being degraded and the risk of the bent locking member falling off from the slide member.

According to the invention recited in claim 2, since a dedicated holder member that is fitted and assembled with the slide member and the bent locking member is used, it is possible to use a lid of an existing configuration as is without the need of developing or manufacturing a lid of a new configuration.

According to the invention recited in claim 3, since the holder member is configured to support resin fulcrum shafts at both sides thereof, use of short moldings of the plurality of resin fulcrum shafts without the need of using a long single resin fulcrum shaft, makes it possible to prevent sink marks during molding.

According to the invention recited in claim 4, since the bent locking member, the resin shaft and the resin fulcrum shaft are integrated, it is possible to reduce the manufacturing process and the number of parts of the bent locking member. Further, since no pipe parts through which the resin shaft or the resin fulcrum shaft is inserted need to be formed in the bent locking member, simplification of the configuration of the bent locking member can be expected. Additionally, since the bent locking member and the holder member are separable, assembly of the bent locking member and the holder member becomes markedly easy.

According to the invention recited in claim 5, since the bent locking member and the resin fulcrum shaft are integrated, it is possible to reduce the manufacturing work and the number of parts of the bent locking member. Further, since no pipe parts for the resin fulcrum shaft need to be formed in the bent locking member, simplification of the configuration of the bent locking member can be expected. Additionally, since the holder member is separable, the bent locking member and the holder member can be easily assembled.

According to the invention recited in claim 6, since the pressing roller that contributes to friction reduction rotatably contacts the inside of the locking pocket of the container body, it is possible to suppress dust generation accompanied by contact.

According to the invention recited in claim 7, since a recess is formed on the circumferential surface of the rotatable resin support shaft while a projection portion that mates with the recess of the resin support shaft is formed on the inner circumferential surface of the pressing roller, fitting of the projection into the recess makes it possible to rotate the resin support shaft and the pressing roller in an integral manner. Accordingly, it is possible to effectively prevent the pressing roller from coming in rolling contact with the circumferential surface of the resin support shaft and generating dust.

According to the invention recited in claim 8, since provision of the plurality of ribs reduces the contact area of the bent locking member with the locking pocket of the container body, the abrasion accompanied by the contact of the bent locking member can be expected to be reduced. Further, since the resin support shaft and the pressing roller can be omitted, the number of parts can be reduced.

According to the invention recited in claim 9, when among the resin shaft, the resin fulcrum shaft and the resin support shaft, at least the resin shaft is formed of polyetheretherketone resin, excellent heat resistance, incombustibility, abrasion resistance, mechanical properties, etc. can be obtained. Further, when at least the resin shaft is formed of polycarbonate resin, excellent impact resistance, heat resistance, dimensional stability, abrasion resistance, etc. can be obtained. Moreover, when at least the resin shaft is formed of polybutylene terephthalate resin, excellent heat resistance and durability can be obtained. Furthermore, when at least the resin shaft is formed of polyacetal resin, excellent impact resistance, abrasion resistance, etc. can be expected. When at least the resin shaft is formed of polyetherimide resin, excellent chemical resistance, water resistance, electrical properties, weather resistance, etc. can be expected.

Additionally, when among the resin shaft, the resin fulcrum shaft and the resin support shaft, at least the resin shaft is formed of polyether sulfone resin, excellent heat resistance, creep resistance, dimensional stability, incombustibility, etc. can be expected. Further, when at least the resin shaft is formed of polyphenylene sulfide resin, it is possible to improve chemical resistance, creep resistance, weather resistance, etc. Furthermore, when at least the resin shaft is formed of polyamide-imide resin, heat resistance, mechanical strength, etc. can be improved.

According to the invention recited in claim 10, since the angle θ formed by the vertical line and the imaginary line is specified to fall within a range from 0.5° or greater to 20° or less, the contact portion between the locking pocket of the container body and the bent locking member can be made close to approximately above or below the center of swing of the bent locking member in the locking mechanism when the lid is locked. Therefore, the abrasion caused by the contact between the locking pocket of the container body and the bent locking member can be reduced.

EMBODIMENTS FOR CARRYING OUT THE INVENTION

Figure 1:
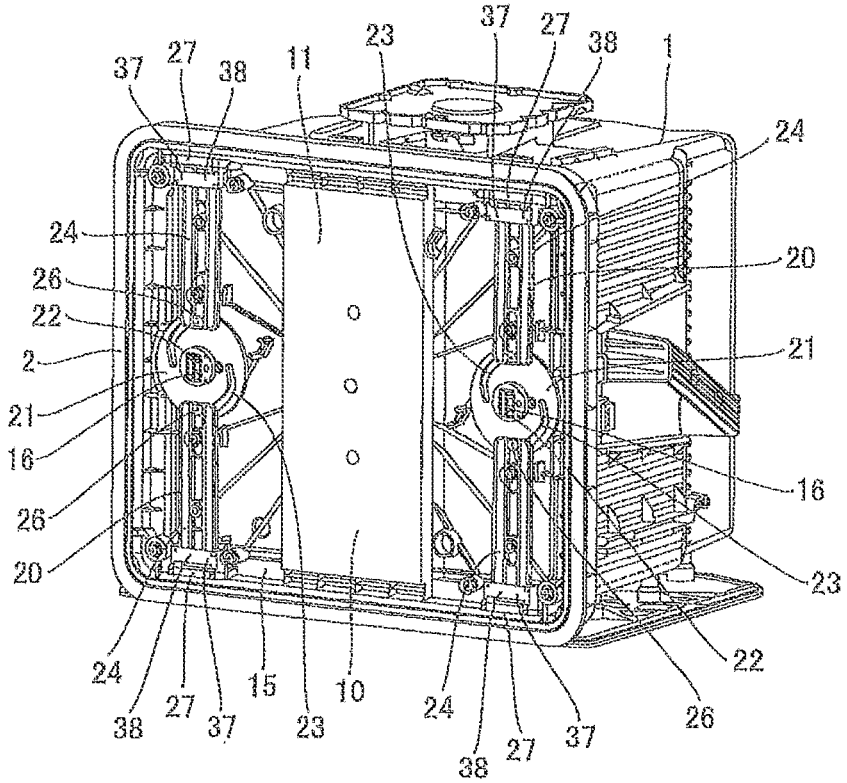
FIG. 1 An overall perspective view schematically showing an embodiment of a substrate storage container according to the present invention.

Hereinafter, a preferred embodiment of the present invention will be described with reference to the drawings. As shown in FIGS. 1 to 6, the substrate storage container in this embodiment is a FOUP including: a lid 10 fitted to an open front 2 of a container body 1 capable of storing a plurality of substrates such as semiconductor wafers in array; and a locking mechanism 20 for locking the lid 10 that is fitted on the front 2 of the container body 1, in which a locking claw 27 is coupled with a connecting bar 24 of the locking mechanism 20 in a rotatable manner by means of a resin pin 31. Thereby, this FOUP contributes to achieving Goal 9 of SDGs (the Sustainable Development Goals: the United Nations' international goals for sustainable development, consisting of 17 global goals and 169 targets (achievement criteria)) adopted at the United Nations Summit.

Although not shown, the semiconductor wafers are of thin, brittle, high-quality silicon wafers with a diameter of 300 mm, for example, having circuit patterns formed on their surfaces. Twenty-five semiconductor wafers are accommodated inside the container body 1, and vertically arranged in array at a predetermined interval.

The container body 1 and the lid 10 are configured by assembling a plurality of parts each formed by injection molding of molding material containing appropriate resins. Examples of resins contained in the molding material include polycarbonate (PC) resin, cycloolefin polymer (COP) resin, cycloolefin copolymer (COC) resin, polypropylene (PP) resin, polyetherimide (PEI) resin, and polyetherketone (PEK) resin, polyetheretherketone (PEEK) resin, polybutylene terephthalate (PBT) resin, polyacetal (POM) resin, and other thermoplastic resins such as liquid crystal polymer and alloys thereof.

Added as necessary to these resins are conductive materials such as carbon fibers, carbon powder, carbon nanotubes, conductive polymers and the like, and various antistatic agents such as anionic, cationic, and nonionic antistatic agents. Furthermore, benzotriazole-based, salicylate-based, cyanoacrylate-based, oxalic acid anilide-based, and hindered amine-based ultraviolet absorbers may be added, and glass fibers, carbon fibers, and the like that improve rigidity may be also added, selectively.

Figure 2:
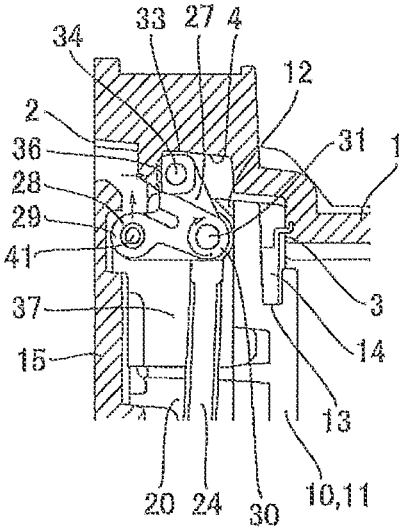
FIG. 2 An explanatory cross-sectional view of essential parts schematically showing the relationship between a container body, a lid, and a locking mechanism in the embodiment of the substrate storage container according to the present invention.
Figure 3:
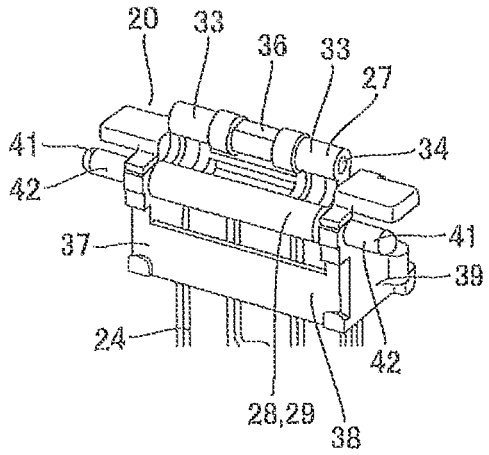
FIG. 3 A perspective view of essential parts from the front side, schematically showing a connecting bar, a locking claw, and a holder of the locking mechanism in the embodiment of the substrate storage container according to the present invention.

As shown in FIGS. 1 and 2, the container body 1 is formed by injection molding into a front open box having a laterally long open front 2. Formed on the both the interior side walls are pairs of left and right teeth, which oppose each other and support semiconductor wafers horizontally, and are arranged vertically at a predetermined interval. Each of the teeth is formed in an elongated plate extending in the front-rear direction. The front 2 of the container body 1 is formed so that the brim thereof is extended laterally outwards via a step from the circumferential wall of the container body 1 while the flat shoulder surface of the step defines a sealing surface 3 for the lid 10. Substantially rectangular hollows are formed as locking pockets 4 for the locking mechanism 20, at left and right positions on the upper and lower sides of the front inner circumference of the container body 1.

As shown in FIGS. 1 and 2, the lid 10 is an existing type composed of a lid housing 11 that is attachably and removably fitted to the open front 2 of the container body 1 and has a substantially rectangular shape in a front view, and a front plate 15 that is exposed to the outside to cover the front side of the lid housing 11. The locking mechanism 20 is interposed between the front plate 15 and the hollows at the left and right positions on the front side of the lid housing 11.

The lid housing 11 has a shallow-bottomed box-shaped in cross section (or approximately tray-shaped in cross section), for example, and is formed with passage openings 12 for locking mechanism 20, bored at both the left and right positions on the upper and lower sides of the circumferential wall thereof, so as to oppose respective locking pockets 4 of the container body 1. The lid housing further has a vertically elongated front retainer of elastic pieces, attached on the middle section on the rear side thereof so as to oppose the rear wall of the container body 1 and hold the front peripheral edges of the semiconductor wafers horizontally. Formed around the peripheral edge on the rear side of the lid housing 11 is a frame-shaped fitting groove 13, into which an elastic sealing gasket 14 that comes into pressure contact with the sealing surface 3 of the container body 1 is fitted.

The front plate 15 is formed of, for example, a laterally elongated transparent plate or opaque plate, and has an operation hole 16 for the locking mechanism 20 bored therethrough at the approximately middle on both sides. This operation hole 16 enables the T-shaped operation key of the lid opening/closing device, standardized by the SEMI standards, to pass therethrough, and as the operation key is turned at predetermined rotation angle, the locking mechanism 20 is operated to perform a locking or unlocking operation. This front plate 15 is slightly projected forward from the front 2 of the container body 1 at the initial stage when the lid 10 is fitted to the open front 2 of the container body 1. When the lid 10 is fitted and locked completely by the locking mechanisms 20, the lid 10 is set approximately flush with the front 2 of the container body 1 to fit within specified dimensions (see FIG. 2).

As shown in FIGS. 1 to 6, the locking mechanism 20 includes: a pair of left and right operating reels 21 that are supported by the lid 10 and turned by a key operation from outside the lid opening/closing device; a plurality of pairs of connecting bars 24 that move upward and downward as each operating reel 21 turns; a plurality of locking claws 27 that can project from the passage openings 12 of the lid 10 and become engaged with the locking pockets 4 on the front inner circumference of the container body 1 as the connecting bars 24 advance; and a plurality of holders 37 fitted on each of the connecting bars 24 and the locking claws 27.

The operating reel 21, the connecting bar 24, the locking claw 27 and the holder 37 of the locking mechanism 20 are formed by injection molding using molding material containing appropriate resins. Examples of the specified resins for the molding material include: polyetheretherketone (PEEK) resin, which is excellent in heat resistance, incombustibility, abrasion resistance, mechanical properties, etc.; polycarbonate (PC) resin, which is excellent in impact resistance, heat resistance, dimensional stability, abrasion resistance, etc.; polybutylene terephthalate (PBT) resin, which is excellent in heat resistance and durability; polyacetal (POM) resin, which is excellent in impact resistance, abrasion resistance, etc.; polyetherimide (PEI) resin, which is excellent in chemical resistance, water resistance, electrical properties, weather resistance, etc.; polyether sulfone (PES) resin, which is excellent in heat resistance, creep resistance, dimensional stability, incombustibility, etc.; polyphenylene sulfide (PPS) resin, which is excellent in chemical resistance, creep resistance, weather resistance, etc.; and polyamide-imide (PAI) resin, which is excellent in heat resistance, mechanical strength, etc., and alloys of these.

As shown in FIG. 1, each operating reel 21 is given in a substantially convex-shaped disc form in which a reel lid is attached to the center of the disc-shaped reel body via a rotary bearing. The operating reels are rotatably supported in the middle of the lid housing 11 at both sides on the front face thereof. The operating reel 21's center portion, designated at 22, forming the reel lid projected toward the front plate 15, opposes the operation hole 16 of the front plate 15. The operation key of the lid opening/closing device passes through the operation hole 16 and is inserted into the operation hole so as to turn the operating reel 21 automatically by a predetermined rotational angle. A pair of curved grooves 23 are bored 180° apart from each other near the peripheral edge of the operating reel 21 so that each curved groove 23 is formed in a semicircular arc shape. The proximal end of connecting bar 24 is coupled with the curved groove 23.

Figure 4:
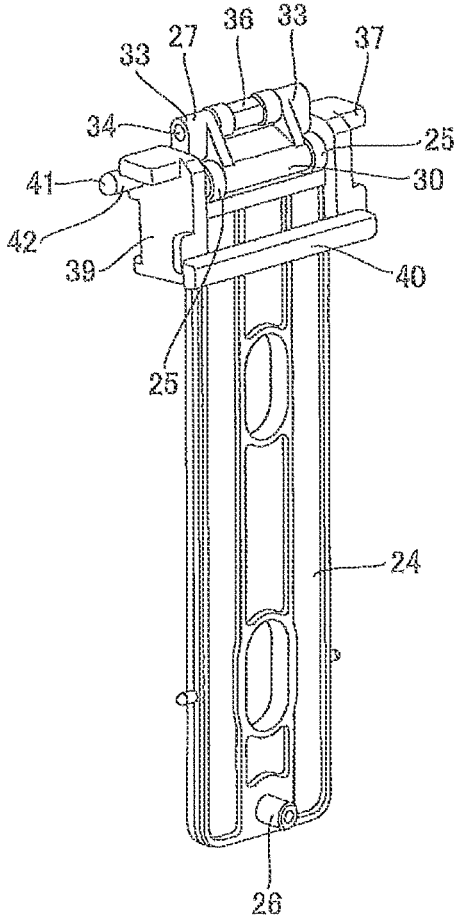
FIG. 4 A perspective explanatory view from the back side, schematically showing the connecting bar, the locking claw, and the holder of the locking mechanism in the embodiment of the substrate storage container according to the present invention.
Figure 5:
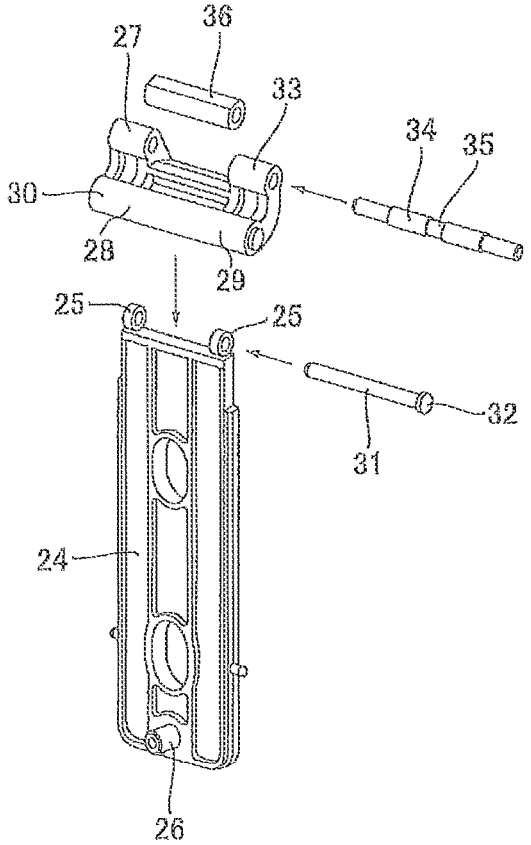
FIG. 5 An exploded perspective view schematically showing the connecting bar and the locking claw of the locking mechanism in the embodiment of the substrate storage container according to the present invention.
Figure 6:
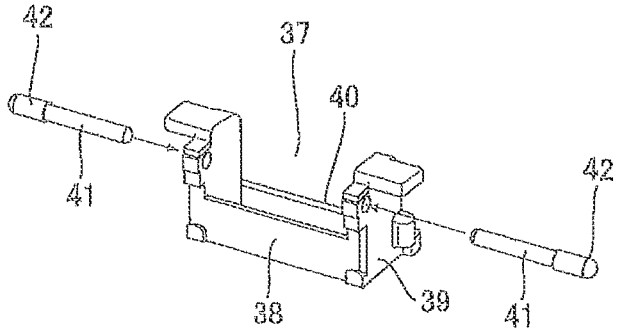
FIG. 6 A perspective explanatory view from the front side, schematically showing the holder in the embodiment of the substrate storage container according to the present invention.

As shown in FIG. 1, a plurality of pairs of connecting bars 24 are slidably arranged on both sides of the front face of the lid housing 11, and a pair of connecting bars 24 are laid out above and below the operating reel 21. As shown in FIGS. 4 and 5, each connecting bar 24 is formed as an elongated plate with guide long slots and has a pair of pipe parts 25 formed side by side in the distal part thereof. Each pipe part 25 is formed in a cylindrical shape. Further, a cylindrical latch boss 26 is integrally formed at the proximal end on the rear side of the connecting bar 24. This latch boss 26 is loosely fitted in a slidable manner into the curved groove 23 of the operating reel 21. This loose fit of the latch boss 26 allows the connecting bar 24 to move up and down as being guided by the guide of the lid housing 11 as the operating reel 21 turns.

As shown in FIGS. 2 to 5, each locking claw 27 is formed in a bent configuration having a substantially L-shaped cross-section or substantially V-shaped cross-section with a narrower width than the conventional type in order to improve rigidity. A forepart 28 on the front side of the bent configuration is oriented toward the front plate 15 of the lid 10. The forepart 28 on the front side forms a cylindrical fulcrum pipe 29 while a cylindrical joint pipe 30 is formed near the angled portion on the rear side and located on the lid housing 11 side of the lid 10. This joint pipe 30 is coupled with the distal part of the connecting bar 24 by means of a separate resin pin 31 so that the locking claw can swing in the thickness direction (back and forth direction) of the lid 10.

As shown in FIGS. 2 and 5, unlike the conventional metal pin 50, the resin pin 31 is made of a specified molding material and has a diameter of 1.5 mm or greater, preferably 1.5 mm or greater and 4 mm or less, more preferably 3 mm, or is formed even more preferably into a thick pin with a diameter of 4 mm. The resin pin is formed with an anti-fall flange 32 protruding from the peripheral surface at the end portion thereof as necessary and is arranged penetrating through the paired pipe parts 25 in the distal part of the connecting bar 24 and the joint pipe 30 of the locking claw 27 so as to couple the connecting bar 24 with the locking claw 27 in a swingable manner.

The specified molding material for the resin pin 31 is the molding material similar to that for the locking mechanism 20, specifically, including: polyetheretherketone resin, which is excellent in heat resistance, incombustibility, abrasion resistance, mechanical properties, etc.; polycarbonate resin, which is excellent in impact resistance, heat resistance, dimensional stability, abrasion resistance, etc.; polybutylene terephthalate resin, which is excellent in heat resistance and durability; polyacetal resin, which is excellent in impact resistance, abrasion resistance, etc.; polyetherimide resin, which is excellent in chemical resistance, water resistance, electrical properties, weather resistance, etc.; polyether sulfone resin, which is excellent in heat resistance, creep resistance, dimensional stability, incombustibility, etc.; polyphenylene sulfide resin, which is excellent in chemical resistance, creep resistance, weather resistance, etc.; and polyamide-imide resin, which is excellent in heat resistance, mechanical strength, etc., and alloys of these.

A distal part 33 of the locking claw 27 is oriented toward the passage opening 12 of the lid 10, and is made to fork with a substantially groove shape therebetween so as to form a depression. As shown in FIGS. 2 to 5, a thick resin support pin 34 is disposed in a freely rotatable manner between the branches of the forked distal part 33 of the locking claws 27. A cylindrical pressing roller 36 that comes into contact with the inside of the locking pocket 4 in the container body 1 is fitted through on the resin support pin 34.

Unlike the conventional metal pin 50, the resin support pin 34 is made of the molding material similar to that of the locking mechanism 20 and the resin pin 31, and is formed into a stepped pin with a diameter of 1.5 mm or greater, preferably 1.5 mm or greater to 4 mm or less, more preferably 3 mm, or even more preferably 4 mm, and is disposed penetrating the resin pressing roller 36. This support pin is made narrower at least on the peripheral surface in the center, of both the ends and the center, forming a small-diametric recess 35. The peripheral surface at the end of portion of the resin support pin 34 has a protruding large-diametric flange as necessary, which contacts the side surface of the distal part of the locking claw 27 to prevent a positional shift.

The pressing roller 36 is disposed between the branches of the forked distal part 33 of the locking claws 27, and has an enlarged diameter projection formed on the inner circumferential surface thereof to be press-fitted into the recess 35 of the resin support pin 34. This close fitting between the recess 35 and the projection allows the pressing roller to rotate integrally with the resin support pin 34 and rotatably slide inside the locking pocket 4 of the container body 1. This integration of the resin support pin 34 and the pressing roller 36 effectively prevents the pressing roller 36 from rotating relative to the circumferential surface of the resin support pin 34 and rubbing its inner circumferential surface, thereby effectively preventing the generation of particles.

As shown in FIGS. 1, 3, 4 and 6, the holder 37 is shaped in a substantially rectangular cylindrical form in plan view, including: an opposite cover plate 38 of a rectangular shape in front view, opposite to the front side of the connecting bar 24 and the locking claw 27; a pair of left and right side plates 39 that are disposed on both sides of the opposing cover plate 38 to hold the connecting bar 24 and the locking claw 27 therebetween; and an anti-falling bar 40 disposed on the rear surface side of the connecting bar 24 and bridged between the paired side plates 39, and is fitted on the distal end side of the connecting bar 24 and the locking claw 27.

The paired side plates 39 of the holder 37 are formed in a vertically long shape taller than the opposite cover plate 38. The paired side plates 39 of the holder 37 are each formed with a through-hole which is opposite the fulcrum pipe 29 of the forepart 28 of the locking claw 27 from left or right sides. Resin fulcrum pins 41 are made to pass through respective paired through-holes, and the penetrated portions of the paired resin fulcrum pins 41 that penetrate through respective side plates 39 of the holder 37 are inserted in a relatively rotatable manner into the fulcrum pipe 29 of the forepart 28 of the locking claw 27 from left and right sides. The thus insertion of the paired resin fulcrum pins 41 in a relatively rotatable manner into the fulcrum pipe 29 of the locking claw 27 from both sides, enables the locking claw 27 to swing in an arc on the forepart 28 as its center.

As shown in FIGS. 2 to 4 and 6, each resin fulcrum pin 41, differing from the conventional metal pin 50, is made of the molding material similar to that of the locking mechanism 20 and the resin pin 31, and is formed as a thick pin with a diameter of 1.5 mm or greater, preferably 1.5 mm or greater to 4 mm or less, more preferably 3 mm, or even more preferably 4 mm. A flange 42 having an enlarged diameter that contacts the side plate 39 of the holder 37 to prevent a positional shift is formed protruding from the peripheral surface of the end portion of the resin fulcrum pin 41.

In the above configuration, when the lid 10 is fitted and locked to the open front face 2 of the container body 1, the lid 10 is first fitted into the open front face 2 of the container body 1 by a lid opening/closing device. At this timing, the front plate 15 of the lid 10 is positioned slightly protruding forward from the front face 2 of the container body 1 and is not flush with the front face 2 of the container body 1.

When the lid 10 has been fitted to the open front 2 of the container body 1, the operation keys of the lid opening/closing device rotate respective operating reels 21 of the locking mechanism 20 in one direction by the angle of 90°. This rotation of the operating reels 21 moves the plurality of pairs of connecting bars 24 from the reference positions toward the circumferential edge of the lid housing 11, and the advancing motion of the connecting bar 24 causes the locking claw 27 to swing pivoting on the fulcrum pipe 29 of the forepart 28, passing from the interior of the lid housing 11 through the passage opening 12 and projecting out of the lid housing while the pressing roller 36 of the swung locking claw 27 fits into and becomes engaged inside the locking pocket 4 of the container body 1.

By means of the fitting and engagement of the locking claws 27 as above, the lid 10 is accurately drawn in and pressed fitted to a specified position within the front side of the container body 1, as shown in FIG. 2, and the front plate 15 is locked with the front face 2 of the container body 1 in a state that the front plate 15 is flush with the front surface. The arrow in FIG. 2 shows the direction of the reaction force.

On the other hand, when the lid 10 is unlocked and removed from the front face 2 of the container body 1, the operation keys of the lid opening/closing device turn respective operating reels 21 of the locking mechanism 20 by 90° to the original reference positions. This reverse rotation of the operating reels 21 returns the plural pairs of connecting bars 24 in the advanced positions to the original reference positions in the lid 10, and the retracting motion of the connecting bar 24 causes the locking claw 27 that has been projected to swing pivoting on the fulcrum pipe 29 of the forepart 28, passing from the locking pocket 4 of the container body 1 through the passage opening 12, and revert back to the interior of the lid housing. This swinging and returning of the locking claw 27 allow removal of the lid 10 that has fitted to the front face 2 of the container body 1 so that the lid 10 is pulled out and removed from the front face 2 of the container body 1 by means of the lid opening/closing device.

According to the above configuration, since the resin pins 31, the resin support pin 34, and the resin fulcrum pins 41, made of resin are used instead of the metal pins 50, diverse adverse effects on the semiconductor wafers in the container body 1 can be eliminated. Furthermore, since the diameters of the resin pin 31, the resin support pin 34, and the resin fulcrum pins 41 are specified to be 1.5 mm or greater, other than the conventional diameter of 1 mm, it is possible to improve the rigidity while considering the thickness of the lid housing 11. Accordingly, even if the locking mechanism 20 is used repeatedly over a long period of time, it is possible to effectively exclude the risk of the coupling strength between the connecting bar 24 and the locking claw 27 being lowered, and the risk of the locking claw 27 falling off from the distal part of the connecting bar 24.

Also, when the resin pin 31, the resin support pin 34, and the resin fulcrum pins 41 are molded from polyetheretherketone resin, polycarbonate resin, etc., which is excellent in abrasion resistance, etc., it is possible to reduce dust generation accompanied by abrasion drastically. Further, since the dedicated holder 37 is used, the existing lid 10 can be used as is without need to develop or manufacture a new configuration of lid 10 that pivotally supports the locking claw 27. Furthermore, since a pair of resin fulcrum pins 41 are used instead of using of a single long resin fulcrum pin 41, each of the resin fulcrum pins 41 can be molded shorter to prevent sink marks during molding.

Since the locking claw 27 is narrower than the conventional locking claw 27A, it is possible to expect that the strength of the locking claw 27 is greatly improved. Further, if the flange that have an identifying function is formed around the peripheral surface of the end of the resin support pin 34, no mistake in the mounting direction of the resin support pin 34 will occur when attaching the pressing roller 36 to the locking claw 27. Furthermore, since the pressing roller 36 that contributes to friction reduction comes into sliding rotational contact with the inside of the locking pocket 4 of the container body 1, particle generation can be greatly reduced.

Figure 7:
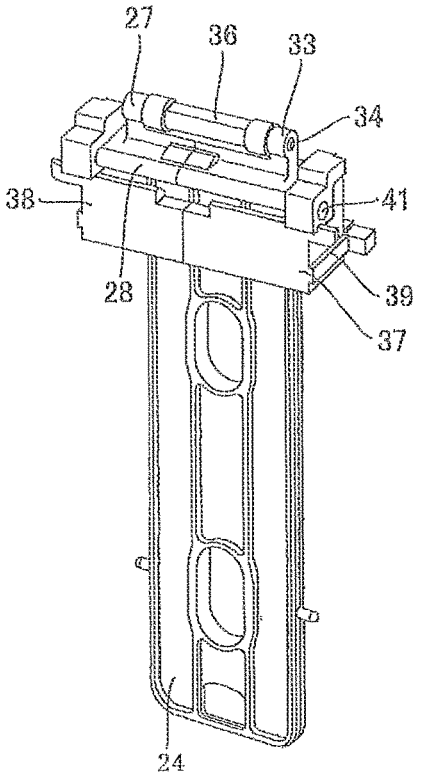
FIG. 7 A perspective explanatory view from the front side, schematically showing a connecting bar, a locking claw, and a holder of a locking mechanism in a second embodiment of a substrate storage container according to the present invention.
Figure 8:
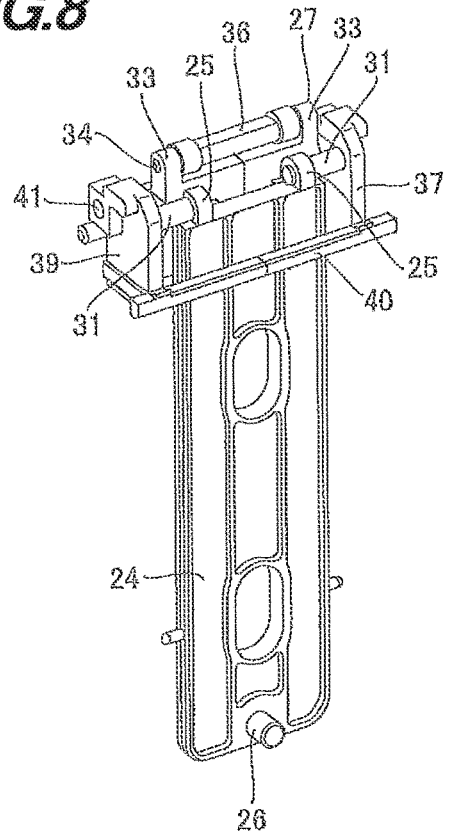
FIG. 8 A perspective explanatory view from the back side, schematically showing the connecting bar, the locking claw, and the holder of the locking mechanism in the second embodiment of the substrate storage container according to the present invention.

Next, FIGS. 7 and 8 show a second embodiment of the present invention, in which the locking claw 27 and the holder 37 of the locking mechanism 20 are made separable at the center with respect to the width direction of the connecting bar 24, and the configuration of the locking claw 27 is modified.

The locking claw 27 is formed in a bent configuration having a substantially L-shaped cross-section or substantially V-shaped cross-section, and has resin fulcrum pins 41 on both sides in the forepart on the front side thereof. The paired resin fulcrum pins 41 are formed projecting in a boss shape and inserted into and rotatably supported by respective through-holes of paired side plates 39 of the holder 37 while the resin pins 31 are supported horizontally at both sides on the rear side of the locking claw 27 with a gap defined between the rear side of the locking claw 27 and the paired resin pins 31. Each resin pin 31 is rotatably penetrated through the pipe part 25 of the connecting bar 24. The other parts are the same as those in the above embodiment, so the explanation will be omitted.

Also in this embodiment, the same effects as in the above embodiment can be expected, and in addition, the locking claw 27, the resin pins 31, and the resin fulcrum pins 41 are integrated so that it is obvious that the manufacturing process and the number of parts for the locking claw 27 can be reduced. Further, since there is no need to form either a fulcrum pipe 29 or a joint pipe 30 in the locking claw 27, the structure of the locking claw 27 can be expected to be simplified. Furthermore, since both of locking claw 27 and the holder 37 can be separated into left and right parts, assembly of the locking claw 27 and the holder 37 can be really simplified.

Figure 9:
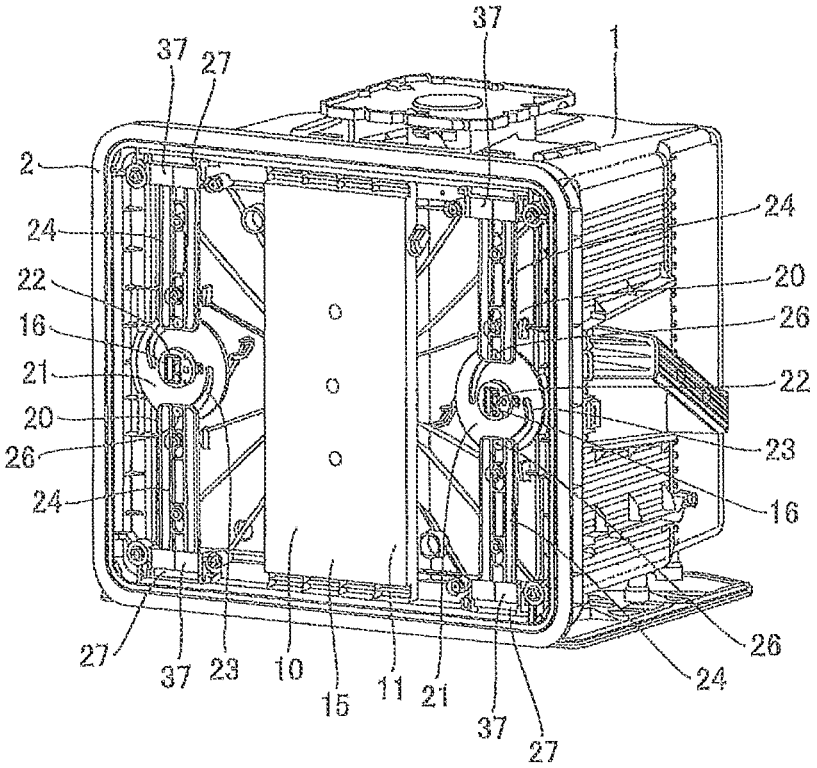
FIG. 9 An overall perspective view schematically showing a third embodiment of a substrate storage container according to the present invention.
Figure 10:
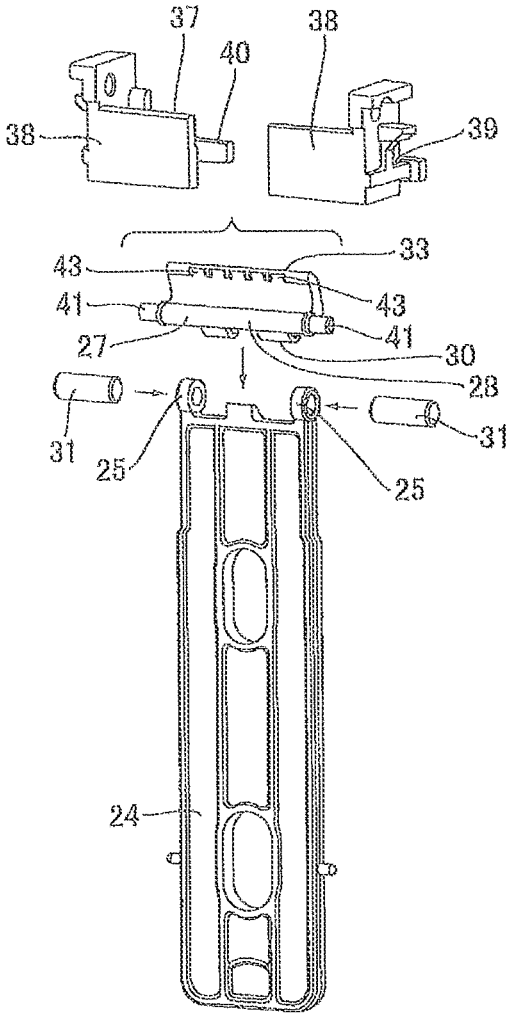
FIG. 10 A perspective explanatory view from the front side, schematically showing a connecting bar, a locking claw, and a holder of a locking mechanism in the third embodiment of the substrate storage container according to the present invention.
Figure 11:
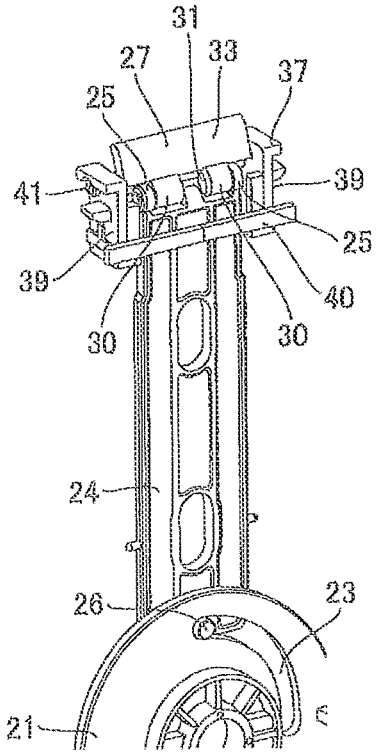
FIG. 11 A perspective explanatory view from the back side, schematically showing an operating reel, the connecting bar, the locking claw, and the holder of the locking mechanism in the third embodiment of the substrate storage container according to the present invention.

Next, FIGS. 9 to 11 show a third embodiment of the present invention, in which the configuration of the locking claw 27 is modified, and the holder 37 is made separable at the center with respect to the width direction of the connecting bar 24.

As shown in FIGS. 10 and 11, the locking claw 27 is formed in a bent configuration having a substantially L-shaped cross-section or substantially V-shaped cross-section, and has resin fulcrum pins 41 on both side of the forepart on the front surface side. A pair of resin fulcrum pins 41 are formed projecting in a boss shape and inserted into and rotatably supported by respective through-holes of paired side plates 39 of the holder 37. A pair of joint pipes 30 located on the lid housing 11 side of the lid 10 are formed side by side near the bent portion on the rear side of the locking claw 27. A short resin pin 31 that penetrates through the pipe part 25 of the connecting bar 24 is inserted to each of the joint pipes 30 so that the pipe part 25 can rotate relative to the joint pipe.

The distal part 33 of the locking claw 27 is not bifurcated but is formed into a tapered plate shape. A plurality of ribs 43 that come in contact with the inside of the locking pocket 4 of the container body 1 are arrayed at a predetermined interval in the lateral direction on, at least, the front face of the distal part 33. The other parts are the same as those in the above embodiment, so the explanation will be omitted.

In this embodiment as well, the same effects as in the above embodiment can be expected. In addition, the locking claw 27 and the resin fulcrum pin 41 are integrated so that it is obvious that the manufacturing process and the number of parts for the locking claw 27 can be reduced. Further, since there is no need to form the fulcrum pipe 29 in the locking claw 27, the structure of the locking claw 27 can be expected to be simplified. Furthermore, since the holder 37 can be separated into a pair of left and right parts, assembly of the locking claw 27 and the holder 37 can be really simplified.

Moreover, provision of the plurality of ribs 43 for the locking claw 27 reduces the contact area of the locking claw 27 with the locking pocket 4 of the container body 1, so that it is possible to greatly expect reduction of abrasion accompanied by contact. Further, the employment of the plurality of ribs 43 can omit use of the resin support pin 34 and the pressing roller 36, which contributes to a reduction in the number of parts.

Figure 12:
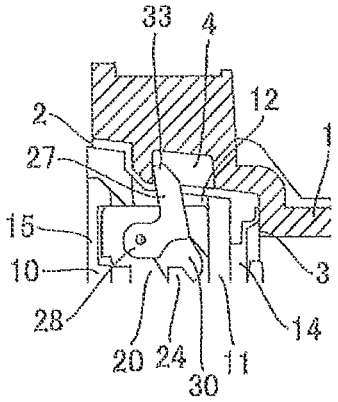
FIG. 12 An explanatory view showing a fourth embodiment of a substrate storage container according to the present invention, where (a) is an explanatory cross-sectional view of essential parts, showing a state in which a lid is fitted to the open front of a container body; (b) is a cross-sectional explanatory view of essential parts showing a locking mechanism in the fully locked state, and (c) is a cross-sectional explanatory view of essential parts showing the locking mechanism in the unlocked state.
Figure 12:
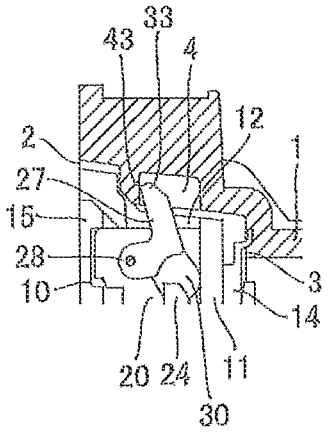
Figure 12:
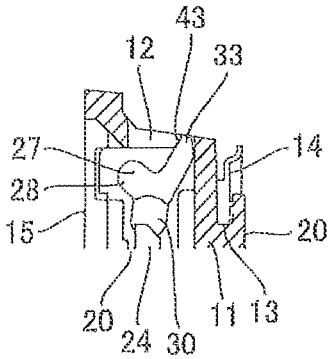
Figure 13:
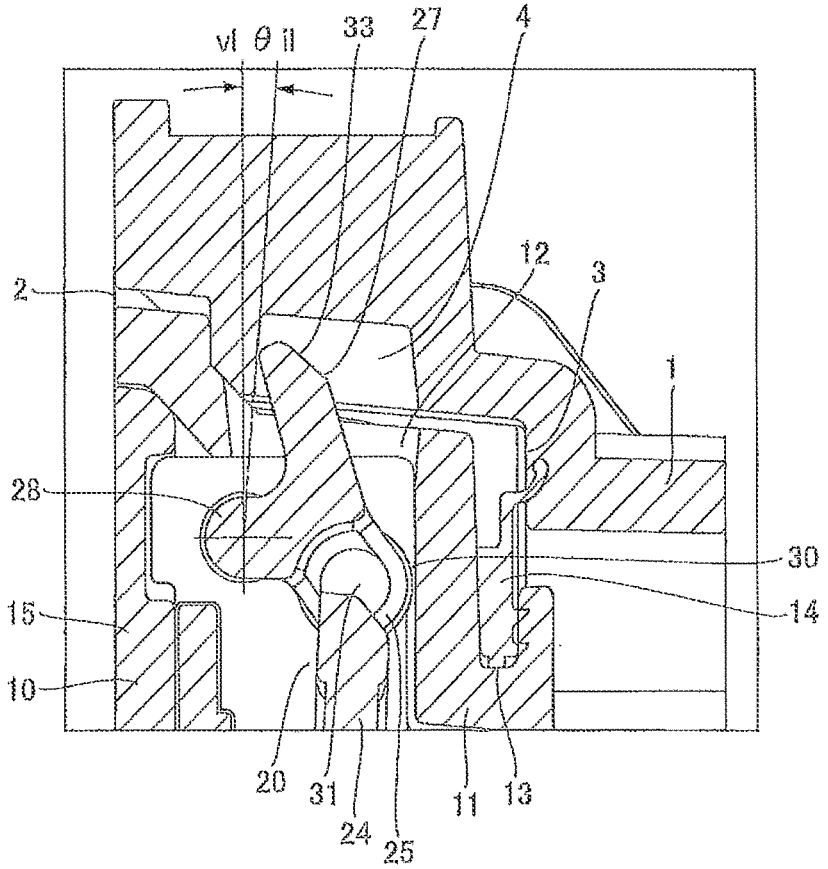
FIG. 13 A cross-sectional explanatory view schematically showing the relationship between the container body, the lid, and the locking mechanism in the fourth embodiment of the substrate storage container according to the present invention.
Figure 14:
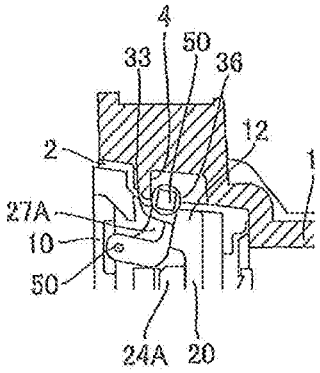
FIG.14 Prior Art
FIG. 14 An explanatory view showing a conventional substrate storage container, where (a) is a cross-sectional explanatory view showing a state in which a lid is fitted to the open front of the container body, and (b) is a cross-sectional explanatory view showing a locking mechanism in the fully locked state, and (c) is a cross-sectional explanatory view showing the locking mechanism in the unlocked state.
Figure 14:
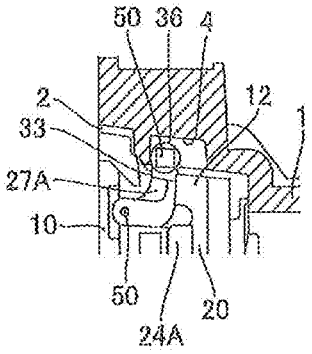
FIG.14 Prior Art
Figure 14:
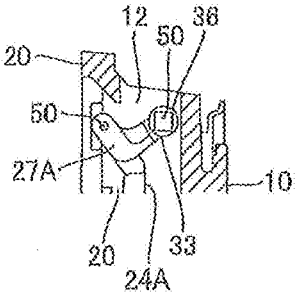
FIG.14 Prior Art

Next, FIGS. 12(*a*), 12(*b*), 12(*c*) and 13 show a fourth embodiment of the present invention, in which the position of the forepart 28 in the locking claw 27 is modified so that an angle θ formed by a vertical line vl and an imaginary line il is specified to fall within a range from 0.5° or greater to 20° or less, where the vertical line vl (see FIG. 13) is drawn from the center of swing of the locking claw 27 when the locking mechanism 20 is locked, toward the locking pocket 4 of the container body 1 and the imaginary line il is drawn from the center of swing of the locking claw 27 when the locking mechanism 20 is locked, to the position of contact of the distal part 33 of the locking claw 27 with the locking pocket 4 of the container body 1.

The distal part 33 of the locking claw 27 is formed into a tapered plate shape. The distal part 33 is formed as necessary with the plurality of ribs 43 that come in contact with the inside of the locking pocket 4 of the container body 1 along the left-to-right width direction on, at least, the front side thereof. Generally, the angle θ formed by the vertical line vl and the imaginary line il is about 25°, but in this embodiment, it is specified to be 0.5° or greater to 20° or less, preferably 2.2° or greater to 10° or less, more preferably 3.2° or greater to 5.2° or less, still more preferably 4.2°. The other parts are the same as those in the above embodiment, so the explanation will be omitted.

In the above configuration, when the lid 10 is fitted to the open front face 2 of the container body 1 and the operation keys of the lid opening/closing device turn respective operating reels 21 of the locking mechanism 20 in one direction by the angle of 90°, the plural pairs of connecting bars 24 advance from the reference positions toward the peripheral edge of the lid housing 11 as each operating reel 21 turns, and the advancing motion of the connecting bar 24 causes the locking claw 27 to swing pivoting on the forepart 28, passing from the interior of the lid housing 11 through the passage opening 12 and project to out of the lid housing (see FIG. 12(*a*)) while the distal part 33 of the swung locking claw 27 fits and becomes engaged inside the locking pocket 4 of the container body 1 by means of ribs 43 (see FIG. 12(*b*)).

By means of the fitting and engagement of the locking claws 27 as above, the lid 10 is accurately drawn in and press-fitted to specified positions within the front side of the container body 1 and the front plate 15 is locked with the front face 2 of the container body 1 in a state that the front plate 15 is flush with the front surface.

On the other hand, when in order to unlock and remove the lid 10 from the container body 1 the operation keys of the lid opening/closing device turn respective operating reels 21 of the locking mechanism 20 by 90° to the original reference positions, this reverse rotation of the operating reels 21 reverts the plural pairs of connecting bars 24 back to the original reference positions in the lid 10, and the retracting motion of the connecting bar 24 causes the locking claw 27 to swing pivoting on the forepart 28, passing from the locking pocket 4 of the container body 1 through the passage opening 12, and revert back to the interior of the lid housing. This swinging and returning of the locking claw 27 allow removal of the lid 10 that has fitted to the front face 2 of the container body 1 (see FIG. 12(*c*)) so that the lid 10 is pulled out and removed from the front face 2 of the container body 1 by means of the lid opening/closing device.

Also in this embodiment, the same effects as in the above embodiment can be expected, and since the angle θ formed by the vertical line vl and the imaginary line il is specified to be 0.5° or greater to 20° or less, which is smaller than the conventional configuration, the contact portion between the locking pocket 4 of the container body 1 and the distal part 33 of the locking claw 27 can be made close to approximately above or below the center of swing of the locking claw 27 in the locking mechanism 20 when the lid 10 is locked. Therefore, the abrasion caused by the sliding contact between the locking pocket 4 of the container body 1 and the distal part 33 of the locking claw 27 can be significantly reduced.

Further, since provision of the plurality of ribs 43 reduces the contact area of the distal part 33 of the locking claw 27 against the locking pocket 4, it is possible to greatly expect reduction of abrasion accompanied by contact. Further, the employment of the ribs 43 can omit use of the resin support pin 34 and the pressing roller 36, which contributes to a reduction in the number of parts.

Additionally, the latch boss 26 of the connecting bar 24 in the above embodiment may have a cylindrical roller excellent in abrasion resistance rotatably fitted therein so that the roller can be slidably and loosely fitted in the curved groove 23 of the operating reel 21 to thereby prevent dust generation. Further, a resin support pin 34 may be fixed and axially supported between the branches of the forked distal part 33 of the locking claws 27 while the pressing roller 36 sliding inside the locking pocket 4 of the container body 1 is rotatably fitted on the resin support pin 34 to thereby disperse stress. Moreover, a small-diametric recess 35 may be partially formed on the circumferential surface of the resin support pin 34 other than the central portion.

In addition, if there are no particular obstacles, a pair of left and right resin support pins 34 namely a plurality of resin support pins 34 may be used and the paired resin support pins 34 are inserted into the branches of the forked distal part 33 of the locking claw 27 so that the penetrated portions of the paired resin support pins 34 that penetrate through distal part 33 are placed close to each other, and the paired resin support pins 34 can be fitted into at least both the ends of the pressing roller 36. Further, the resin support pins 34 may be given as straight pins or the like if no particular problem occurs.

Still more, the opposing covering plate 38 of the holder 37 may be omitted while the paired side plates 39 of the holder 37 may be each formed with a semicircular notch serving as a bearing so as to have each of the resin fulcrum pins 41 fitted to and supported by the respective semicircular notches in a rotatable manner, and the anti-falling bar 40 may be modified into a wider configuration and detachably fixed to the lid housing 11. Moreover, this substrate storage container may be mainly used as the FOUP but can be used as a FOSB (Front Opening Shipping Box) for semiconductor wafer shipment if there are no particular obstacles.

INDUSTRIAL APPLICABILITY

The substrate storage container according to the present invention is used in the manufacturing fields of electric, electronic, precision instruments, and semiconductors, etc.

DESCRIPTION OF REFERENCE NUMERALS

1 container body
2 front face
4 locking pocket
10 lid
11 lid housing
12 passage opening
15 front plate
20 locking mechanism
21 operating reel (operating member)
24 connecting bar (slide member)
25 pipe part
27 locking claw (bent locking member)
28 forepart
29 fulcrum pipe
30 joint pipe
31 resin pin (resin shaft)
32 anti-fall flange
33 distal part
34 resin support pin (resin support shaft)
35 recess
36 pressing roller
37 holder (holder member)
39 side plate (side part)
41 resin fulcrum pin (resin fulcrum shaft)
43 rib
50 metal pin
il imaginary line
vl vertical line
θ angle formed by the vertical line and the imaginary line

The invention claimed is:

1. A substrate container comprising:

a lid that is fitted to an opening of a container body capable of storing a substrate; and a locking mechanism that locks the fitted lid, wherein:

the lid comprises:

a lid housing that is removably fitted to an open front face of the container body; and a front plate that covers a front face of the lid housing, wherein:

the locking mechanism is disposed between the lid housing and the front plate, and a passage opening for the locking mechanism is disposed on a periphery of the lid housing so as to be opposite to a locking pocket on a front inner circumference of the container body, the locking mechanism comprises:

an operating member that is supported on the lid and turned by an external operation;

a slide member that slides as the operating member turns; and a bent locking member that is projected from the passage opening of the lid as the slide member slides and is configured to be engaged with the locking pocket on the front inner circumference of the container body, wherein:

the bent locking member is rotatably connected to a distal part of the slide member by a resin shaft having a diameter of 1.5 mm or greater, and the bent locking member of the locking mechanism is configured to rotate in a thickness direction of the lid while a center of rotation of the bent locking member is arranged at a forepart on a front side of the bent locking member, the locking mechanism comprises a holder member that is fitted and assembled with the slide member and the bent locking member, the forepart on the front side of the bent locking member is rotatably supported on both sides of the holder member by means of a resin fulcrum shaft having a diameter of 1.5 mm or greater, the holder member is configured to support a plurality of resin fulcrum shafts at both sides of the holder member, and penetrated portions of the resin fulcrum shafts that penetrate through respective sides of the holder member are inserted into the forepart on the front side of the bent locking member.

2. The substrate storage container according to claim 1, wherein;

the distal part of the bent locking member is forked into two branches so as to form a substantially groove shape, and a resin support shaft having a diameter of 1.5 mm or greater is inserted through the forked distal part of the bent locking member while a pressing roller that comes in rotatable contact with an inside of the locking pocket of the container body is fitted on the resin support shaft.

3. The substrate storage container according to claim 2, wherein;

the resin support shaft is rotatably mounted between the branches of the forked distal part of the bent locking member, and the resin support shaft being formed with a recess on a peripheral side of the resin support shaft while a projection that mates with the recess of the resin support shaft is formed on an inner circumferential surface of the pressing roller.

4. The substrate storage container according to claim 1, wherein a plurality of ribs that contact the inside of the locking pocket of the container body are formed in a distal part of the bent locking member.

5. The substrate storage container according to claim 2, wherein among the resin shaft, the resin fulcrum shaft and the resin support shaft, at least the resin shaft is formed of polyetheretherketone resin, polycarbonate resin, polybutylene terephthalate resin, polyacetal resin, polyetherimide resin, polyether sulfone resin, polyphenylene sulfide resin, or polyamide-imide resin.

6. The substrate storage container according to claim 1, wherein an angle θ formed by a vertical line and an imaginary line is specified to fall within a range from 0.5° or greater to 20° or less, where the vertical line is drawn from the center of the rotation of the bent locking member when the locking mechanism is locked, toward the locking pocket of the container body and the imaginary line is drawn from the center of the rotation of the bent locking member when the locking mechanism is locked, to a position of the contact of the bent locking member with the locking pocket of the container body.

7. A substrate storage container comprising:

a lid that is fitted to an opening of a container body capable of storing a substrate; and a locking mechanism that locks the fitted lid, wherein:

the lid comprises:

a lid housing that is removably fitted to an open front face of the container body; and a front plate that covers a front face of the lid housing, wherein:

the locking mechanism is disposed between the lid housing and the front plate, and a passage opening for the locking mechanism is disposed on a periphery of the lid housing so as to be opposite to a locking pocket on a front inner circumference of the container body, the locking mechanism comprises:

an operating member that is supported on the lid and turned by an external operation;

a slide member that slides as the operating member turns; and a bent locking member that is projected from the passage opening of the lid as the slide member slides and is configured to be engaged with the locking pocket on the front inner circumference of the container body, wherein:

the bent locking member is rotatably connected to a distal part of the slide member by a resin shaft having a diameter of 1.5 mm or greater, and the bent locking member of the locking mechanism is configured to rotate in a thickness direction of the lid while a center of rotation of the bent locking member is arranged at a forepart on a front side of the bent locking member, the locking mechanism comprises a holder member that is fitted and assembled with the slide member and the bent locking member, the forepart on the front side of the bent locking member is rotatably supported on both sides of the holder member by means of a resin fulcrum shaft having a diameter of 1.5 mm or greater, the bent locking member and the holder member are formed to separate into respective two parts with respect to a width direction of the slide member, and the resin fulcrum shafts to be supported respectively by both side parts of the holder member are formed protruding from respective sides of the forepart on the front side of the bent locking member while resin shafts to be penetrated through the distal part of the slide member are supported on a rear side of the bent locking member.

8. The substrate storage container according to claim 7, wherein:

the distal part of the bent locking member is forked into two branches so as to form a substantially groove shape, and a resin support shaft having a diameter of 1.5 mm or greater is inserted through the forked distal part of the bent locking member while a pressing roller that comes in rotatable contact with an inside of the locking pocket of the container body is fitted on the resin support shaft.

9. The substrate storage container according to claim 8, wherein:

the resin support shaft is rotatably mounted between the branches of the forked distal part of the bent locking member, and the resin support shaft being formed with a recess on a peripheral side of the resin support shaft while a projection that mates with the recess of the resin support shaft is formed on an inner circumferential surface of the pressing roller.

10. The substrate storage container according to claim 7, wherein a plurality of ribs that contact the inside of the locking pocket of the container body are formed in a distal part of the bent locking member.

11. The substrate storage container according to claim 8, wherein among the resin shaft, the resin fulcrum shaft and the resin support shaft, at least the resin shaft is formed of polyetheretherketone resin, polycarbonate resin, polybutylene terephthalate resin, polyacetal resin, polyetherimide resin, polyether sulfone resin, polyphenylene sulfide resin, or polyamide-imide resin.

12. The substrate storage container according to claim 7, wherein an angle θ formed by a vertical line and an imaginary line is specified to fall within a range from 0.5° or greater to 20° or less, where the vertical line is drawn from the center of the rotation of the bent locking member when the locking mechanism is locked, toward the locking pocket of the container body and the imaginary line is drawn from the center of the rotation of the bent locking member when the locking mechanism is locked, to a position of the contact of the bent locking member with the locking pocket of the container body.

13. A substrate storage container comprising:

a lid that is fitted to an opening of a container body capable of storing a substrate; and a locking mechanism that locks the fitted lid, wherein:

the lid comprises:

a lid housing that is removably fitted to an open front face of the container body; and a front plate that covers a front face of the lid housing, wherein:

the locking mechanism is disposed between the lid housing and the front plate, and a passage opening for the locking mechanism is disposed on a periphery of the lid housing so as to be opposite to a locking pocket on a front inner circumference of the container body, the locking mechanism comprises:

an operating member that is supported on the lid and turned by an external operation;

a slide member that slides as the operating member turns; and a bent locking member that is projected from the passage opening of the lid as the slide member slides and is configured to be engaged with the locking pocket on the front inner circumference of the container body, wherein:

the bent locking member is rotatably connected to a distal part of the slide member by a resin shaft having a diameter of 1.5 mm or greater, and the bent locking member of the locking mechanism is configured to rotate in a thickness direction of the lid while a center of rotation of the bent locking member is arranged at a forepart on a front side of the bent locking member, the locking mechanism comprises a holder member that is fitted and assembled with the slide member and the bent locking member, the forepart on the front side of the bent locking member is rotatably supported on both sides of the holder member by means of a resin fulcrum shaft having a diameter of 1.5 mm or greater, resin fulcrum shafts to be supported respectively by both side parts of the holder member are formed protruding from respective sides of the forepart on the front side of the bent locking member, and a plurality of joint pipes are formed near a bent portion on a rear side of the bent locking member while the resin shaft that penetrates through the distal part of the slide member is inserted into each of the joint pipe, whereby the holder member is configured to be separated with respect to a width direction of the slide member.

14. The substrate storage container according to claim 13, wherein:

the distal part of the bent locking member is forked into two branches so as to form a substantially groove shape, and a resin support shaft having a diameter of 1.5 mm or greater is inserted through the forked distal part of the bent locking member while a pressing roller that comes in rotatable contact with an inside of the locking pocket of the container body is fitted on the resin support shaft.

15. The substrate storage container according to claim 14, wherein:

the resin support shaft is rotatably mounted between the branches of the forked distal part of the bent locking member, and the resin support shaft being formed with a recess on a peripheral side of the resin support shaft while a projection that mates with the recess of the resin support shaft is formed on an inner circumferential surface of the pressing roller.

16. The substrate storage container according to claim 14, wherein among the resin shaft, the resin fulcrum shaft and the resin support shaft, at least the resin shaft is formed of polyetheretherketone resin, polycarbonate resin, polybutylene terephthalate resin, polyacetal resin, polyetherimide resin, polyether sulfone resin, polyphenylene sulfide resin, or polyamide-imide resin.

17. The substrate storage container according to claim 13, wherein a plurality of ribs that contact the inside of the locking pocket of the container body are formed in a distal part of the bent locking member.

18. The substrate storage container according to claim 13, wherein an angle θ formed by a vertical line and an imaginary line is specified to fall within a range from 0.5° or greater to 20° or less, where the vertical line is drawn from the center of the rotation of the bent locking member when the locking mechanism is locked, toward the locking pocket of the container body and the imaginary line is drawn from the center of the rotation of the bent locking member when the locking mechanism is locked, to a position of the contact of the bent locking member with the locking pocket of the container body.

* * * * *